US011053785B2

(12) United States Patent
Niemann

(10) Patent No.: US 11,053,785 B2
(45) **Date of Patent: *Jul. 6, 2021**

(54) SYSTEM AND METHODS FOR INCREASING THE PERMEABILITY OF GEOLOGICAL FORMATIONS

(71) Applicant: George W. Niemann, Dallas, TX (US)

(72) Inventor: George W. Niemann, Dallas, TX (US)

( * ) Notice: Subject to any disclaimer, the term of this patent is extended or adjusted under 35 U.S.C. 154(b) by 32 days.

This patent is subject to a terminal disclaimer.

(21) Appl. No.: 16/522,430

(22) Filed: Jul. 25, 2019

(65) Prior Publication Data

US 2019/0345806 A1 Nov. 14, 2019

Related U.S. Application Data

(63) Continuation of application No. 15/656,844, filed on Jul. 21, 2017, now Pat. No. 10,400,566, which is a continuation of application No. 15/098,006, filed on Apr. 13, 2016, now Pat. No. 9,745,839.

(60) Provisional application No. 62/247,939, filed on Oct. 29, 2015.

(51) Int. Cl.
*E21B 43/26* (2006.01)

(52) U.S. Cl.
CPC ..... *E21B 43/26* (2013.01)

(58) Field of Classification Search
CPC ..... E21B 43/003; E21B 43/16; E21B 43/17; E21B 43/26
See application file for complete search history.

(56) References Cited

U.S. PATENT DOCUMENTS

| | | | | |
|---|---|---|---|---|
| 2,871,943 | A * | 2/1959 | Bodine, Jr. | B01J 19/10 166/249 |
| 3,113,621 | A | 12/1963 | Krueger et al. | |
| 3,412,322 | A | 11/1968 | Unterberger | |
| 4,017,121 | A | 4/1977 | Trent | |
| 5,101,899 | A | 4/1992 | Hoskins et al. | |
| 5,323,855 | A | 6/1994 | Evans | |
| 5,465,789 | A | 11/1995 | Evans | |
| 6,176,313 | B1 * | 1/2001 | Coenen | E21B 21/002 166/280.1 |
| 6,227,293 | B1 | 5/2001 | Huffman et al. | |
| 6,427,774 | B2 | 8/2002 | Thomas et al. | |
| 6,499,536 | B1 | 12/2002 | Ellingsen | |
| 7,398,823 | B2 | 7/2008 | Montgomery et al. | |
| 8,689,875 | B2 | 4/2014 | Dudley et al. | |
| 8,746,333 | B2 | 6/2014 | Zolezzi-Garreton | |
| 9,057,232 | B2 | 6/2015 | Cioanta et al. | |

(Continued)

FOREIGN PATENT DOCUMENTS

| | | | | |
|---|---|---|---|---|
| CN | 104278964 A | * | 1/2015 | |
| WO | WO-0001926 A1 | * | 1/2000 | E21B 43/26 |
| WO | WO-2012066290 A2 | * | 5/2012 | E21B 43/108 |

*Primary Examiner* — Jennifer H Gay
(74) *Attorney, Agent, or Firm* — Slater Matsil, LLP

(57) ABSTRACT

A method of increasing a permeability of a strata includes positioning an electromagnetic tool at a first location of the strata, generating a first time-varying magnetic field using the electromagnetic tool, and applying a first time-varying magnetic force to a first magnetic material of the strata using the first time-varying magnetic field, where the strata includes a first plurality of pores. The method further includes fracturing the strata to increase the permeability of the strata proximate the first location using the first time-varying magnetic force.

20 Claims, 14 Drawing Sheets

(56) References Cited

U.S. PATENT DOCUMENTS

| | | | | |
|---|---|---|---|---|
| 9,359,869 | B2 | 6/2016 | Hallundbaek | |
| 9,745,839 | B2 | 8/2017 | Niemann | |
| 9,896,919 | B1 * | 2/2018 | Chen | E21B 43/26 |
| 10,400,566 | B2 * | 9/2019 | Niemann | E21B 43/26 |
| 10,669,829 | B2 * | 6/2020 | Liang | C09K 8/50 |
| 2001/0011590 | A1 | 8/2001 | Thomas et al. | |
| 2005/0269077 | A1 | 12/2005 | Sandberg | |
| 2011/0108277 | A1 | 5/2011 | Dudley et al. | |
| 2011/0127031 | A1 | 6/2011 | Zolezzi Garreton | |
| 2011/0284227 | A1 | 11/2011 | Ayan et al. | |
| 2012/0132416 | A1 | 5/2012 | Zolezzi-Garreton | |
| 2012/0318510 | A1 | 12/2012 | Ocalan | |
| 2013/0341005 | A1 * | 12/2013 | Bruce | E21B 43/08 166/207 |
| 2014/0110103 | A1 | 4/2014 | Hyde et al. | |
| 2014/0290935 | A1 | 10/2014 | Hallundbaek | |
| 2014/0305877 | A1 | 10/2014 | Cioanta et al. | |
| 2014/0332206 | A1 | 11/2014 | Hallundbaek | |
| 2014/0352947 | A1 | 12/2014 | Hallundbaek | |
| 2015/0167440 | A1 | 6/2015 | Kasevich et al. | |
| 2015/0192005 | A1 * | 7/2015 | Saeedfar | E21B 47/13 166/248 |
| 2017/0122087 | A1 | 5/2017 | Niemann | |
| 2017/0321529 | A1 | 11/2017 | Niemann | |
| 2019/0292890 | A1 * | 9/2019 | Liang | E21B 7/15 |
| 2019/0345806 | A1 * | 11/2019 | Niemann | E21B 43/26 |

* cited by examiner

SYSTEM AND METHODS FOR INCREASING THE PERMEABILITY OF GEOLOGICAL FORMATIONS

This application is a continuation of U.S. patent application Ser. No. 15/656,844, entitled "System and Methods for Increasing the Permeability of Geological Formations," filed on Jul. 21, 2017, which is a continuation of U.S. patent application Ser. No. 15/098,006, entitled "System and Methods for Increasing the Permeability of Geological Formations," filed on Apr. 13, 2016, now U.S. Pat. No. 9,745,839 B2 issued on Aug. 29, 2017, which claims the benefit of U.S. Provisional Application No. 62/247,939, entitled "Magnetic Micro Fracking," filed on Oct. 29, 2015, which applications are hereby incorporated herein by reference.

FIELD OF THE INVENTION

The field of invention relates to the production of subsurface hydrocarbon fuels, also referred to as oil, or petroleum. More specifically, the field relates to systems and processes that improve the permeability of geological formations for improved recovery rate of hydrocarbon fuels.

BACKGROUND

Different oil recovery techniques have been developed to extract hydrocarbon fuels from subterranean geological formations. Most conventional oil recovery techniques can be classified into three categories, which include the primary technique, the secondary technique and the tertiary, or enhanced oil recovery (EOR) technique. The primary technique, which uses natural reservoir pressure or gravity to drive oil into the well bore, results in a recovery rate of about 10 percent for the original oil in place (OOIP). Secondary technique, which injects water or gas in the reservoir to displace oil and drive it into the well bore, results in about 20 to 40 percent recovery rate for the OOIP. Tertiary technique, or EOR technique, uses several different approaches to achieve higher recovery rate of about 30 to 60 percent, and may be characterized into three sub-categories that include thermal recovery, gas injection, and chemical injection.

The thermal recovery EOR technique involves the introduction of heat, such as the injection of steam, to heat the crude oil, thus lowering the viscosity of the crude oil, and facilitating the flow of crude oil through, e.g., pores and cracks in the rock formations for increased production. The gas injection EOR technique uses gases, such as natural gas, nitrogen, or carbon dioxide ($CO_2$) to increase the pressure and decrease the viscosity of hydrocarbon fuels for improve oil flow. The chemical injection EOR technique injects chemicals into the reservoir to lower the surface tension that often prevents oil droplets from moving through a reservoir, which may increase, e.g., the effectiveness of waterflooding. Each of these conventional techniques has been hampered by its relatively high cost and, in some cases, by the unpredictability of its effectiveness.

Hydraulic fracturing, or fracking, is a relatively new recovery technique which induces fractures in the rock formations by injecting high-pressure fracking fluid (primarily water, containing sand or other proppants suspended with the aid of thickening agents) into a wellbore. Fractures, or cracks, in the deep-rock formations formed by fracking allow natural gas and petroleum to flow more freely. The early fracking recovery rate for gas was in the 2 to 5 percent range and improved to a current recovery rate of about 20 percent. The limited numbers available to date for oil well fracking indicate approximately a 5 to 6 percent recovery rate of oil.

There is a need for system and methods that can be used to supplement or replace existing oil recovery techniques that have improved recovery rates, and are environmentally friendly.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
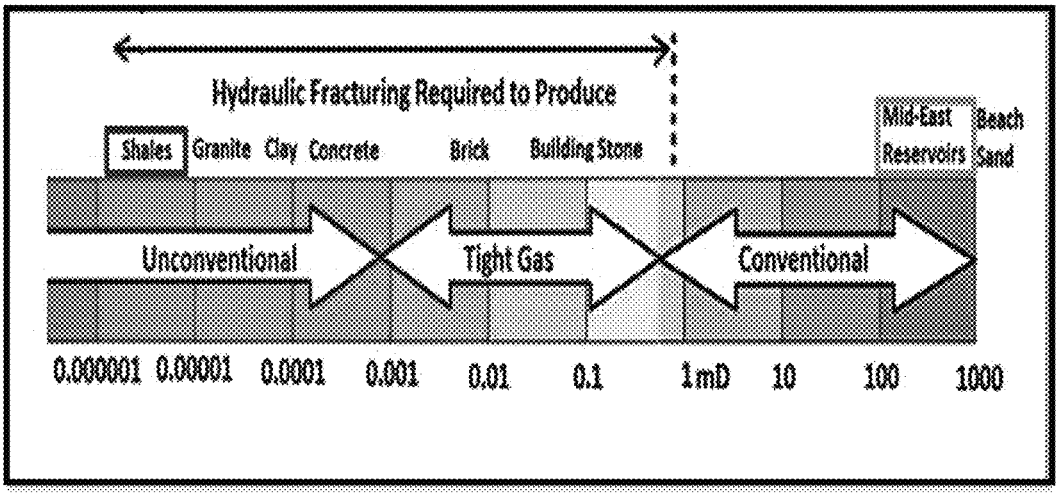
FIG. 1 illustrates the permeability of different materials and corresponding recovery techniques being used currently.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Various embodiments are described with respect to a particular context, namely, methods and system for improving the permeability of geological formations to improve oil recovery rate. In some embodiments, a time-varying electromagnetic field is generated by an electromagnetic tool positioned near or within oil bearing strata. The time-varying electromagnetic field penetrates the strata around the electromagnetic tool, and applies a time-varying magnetic force to susceptible magnetic materials of the strata. The time-varying magnetic force fractures the oil bearing strata at the micrometer or nanometer level and increases the permeability of the strata, resulting in increased oil and/or gas recovery rates. In other embodiments, a time-varying pressure wave is generated by a pressure wave generating device located near or within the geological formations of a reservoir for hydrocarbon fuels. The time-varying pressure wave generates time-varying compressive pressure forces and expansive pressure forces, which forces fracture the geological formations at the micrometer or nanometer level and increase the permeability of the geological formations, resulting in improved oil and/or gas recovery rate. No water is needed for operating the electromagnetic tool or the pressure wave generating device, in some embodiments. In the discussion of the current disclosure, source rocks, strata, rock formations, formations, and geological formations may be used interchangeably.

FIG. 1 illustrates the permeability range of different materials and the corresponding recovery techniques used today for oil and/or gas recovery. Permeability is an indication of the ability of fluid (e.g., oil or gas) to flow through source rocks. A practical unit of permeability is darcy (D) or millidarcy (mD). As illustrated in FIG. 1, for source rocks with permeability of about 1 mD or lager, conventional recovery techniques may be used. For source rocks with low permeability (e.g., smaller than about 0.1 mD), recovery techniques such as hydraulic fracturing may be required for economically viable oil/gas extraction. Hydraulic fracturing used horizontal drilling to increase the drainage exposure area. In addition, fractures in source rocks caused by injected high-pressure fracking fluid facilitate oil flow toward the well bore. However, due to the low permeability of the source rocks, the recovery rate of hydraulic fracturing is only about 5 to 6 percent of OOIP.

Figure 2A:
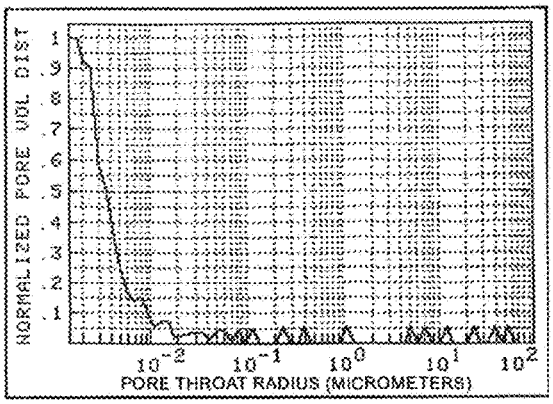
FIGS. 2A and 2B illustrate the statistical distribution of measured pore throat sizes in Barnett Shale and Eagle Ford Shale, respectively.
Figure 2B:
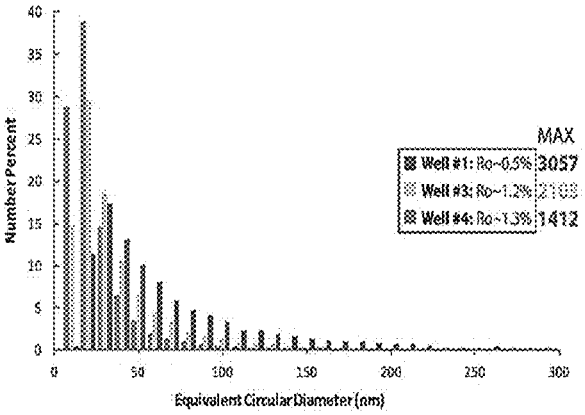

FIGS. 2A and 2B illustrate the statistical distribution of measured pore throat sizes in the Barnett Shale of Fort Worth basin and the Eagle Ford Shale in South Texas, respectively. FIG. 2A shows the results of mercury-porosimetry analysis of samples from the Barnett Shale. As shown in FIG. 2A, eighty percent of the pore throats have a radius of less than 0.005 μm. FIG. 2B shows the histograms of pore throat sizes for samples from three wells in the Eagle Ford Shale. The histograms are binned by equivalent circular diameter values of to nm for pores throat sizes less that 300 nm. FIG. 2B shows that most pore throats have small pore throats sizes (e.g., 0-20 nm).

Pore throat sizes and pore structures are important physical parameters for oil flow and permeability. The Barnett Shale pore throat radius analysis in FIG. 2A provides a detailed description of the pore throat size distribution of the bulk shale. The Eagle Ford shale pore throat size analysis in FIG. 2B shows comparable pore throat dimensions as FIG. 2A. Due to the small pore throat sizes, both the Barnett Sale and the Eagle Ford Shale have shale formations with low permeability, which limits the maximum recovery rate available, as evidenced by the low recovery rate of 5 to 6 percent for fracking productions.

The well flow rate Q of a well, which is typically measured in barrels per day, is given by Equation 1 below:

$$Q = \frac{K * H * \Delta P}{V} \tag{1}$$

where ΔP is the reservoir pressure minus wellbore pressure, V represents the fluid viscosity, H is the height/length of the wellbore through the production strata (also referred to as production zone) and defines the exposed area from which oil drains, and K is the permeability of the source rock.

Equation 1 provides insight into the mechanism of different oil recovery techniques. Gravity induced pressure difference ΔP was the primary flow rate driver for the primary technique. Secondary technique, as well as some EOR techniques (e.g., the gas injection EOR technique) improves well flow rate by artificially increasing ΔP (e.g., by injecting water or gas into the reservoir). The thermal recovery EOR technique, on the other hand, lowers viscosity V by heating the oil-bearing fluid. The limited success of hydraulic fracturing recovery was a result of significantly increasing the value of H by drilling horizontally in the production zone, thereby increasing drainage exposure area. None of the conventional recovery techniques, however, attempts to improve flow rate by increasing the permeability of the oil and gas bearing formations.

As discussed above, hydraulic fracturing fractures the shale formation using physical force. The size of the cracks or fractures in shale formations caused by hydraulic fracturing is in the order of, e.g., millimeters, centimeters, or larger, thus the fractures may be called macro fractures hereinafter. Oil from the micrometer and nanometer-sized pore structures drained out near the macro fractures, resulting in improved oil flow. The result is a 5 to 6 percent recovery rate for hydraulic fracturing. Although fracking benefited from limited increase of oil flow for small areas of source rocks that are exposed by the fractures, areas of source rocks not exposed by the fracture, e.g., source rocks located between the fractures, still have low permeability. Without improving the permeability of source rocks, the recovery rate will likely be limited to an unsatisfactory low level.

To improve the oil/gas recovery rate, the current disclosure proposes applying physical forces at the micrometer and nanometer level to induce micro fractures (e.g., fractures with sizes in the order of micrometers or nanometers) to increase permeability of the formations. Any physical force that can penetrate the formations with sufficient strength to modify pore structures (e.g., induce micro fractures) to improve permeability could be used. For example, electromagnetic forces of attracting and repelling, and pressure induced forces of compression and expansion, could be used to induce micro fractures in the rock formations to improve permeability. Although only electromagnetic forces and pressure forces are discussed as examples, other types of forces that can act on susceptible particles of the formations are also contemplated and are within the scope of the current disclosure.

Table 1 shows the typical compositions of Barnett Shale and Marcellus Shale in New York. Table 2 shows the X-Ray Diffraction (XRD) measurement of the compositions of three wells in Eagle Ford Shale. In both Tables 1 and 2, underlined minerals are magnetic. For example, pyrite ($FeS_2$) and siderite ($FeCO_3$) are paramagnetic, and iron (Fe), which constitutes about 5% of shale, is ferromagnetic. Iron oxide and pyrrhotite are permanent magnetic materials, and exist in both Barnett Shale and Marcellus Shale. Scanning electron microscope (SEM) images (not shown) of Barnett Shale and Eagle Ford Shale show that the pores structures in the shale formation include magnetic materials, such as pyrite mineral structures, iron oxide and pyrrhotite, associated with organic materials (e.g., kerogen). The fact that magnetic particles exist in or near pore structures confirm the viability of using magnetic forces to induce micro fractures for improving permeability. In addition, the pore throat sizes shown in FIGS. 2A and 2B provide useful information for determining the magnitude of forces required to induce micro fractures for increased permeability.

TABLE 1

Shale composition of Barnett Shale and Marcellus Shale

| Mineral | Barnett (%) | Marcellus (%) |
|---|---|---|
| Quartz | 35-50 | 10-60 |
| Clays, primarily illite | 10-50 | 10-35 |
| Calcite, dolomite, siderite | 0-30 | 3-50 |
| Feldspars | 7 | 0-4 |
| Pyrite | 5 | 5-13 |
| Pyrrhotite | >5% | >5% |
| Iron Oxide | 5~10% | 5~10% |
| Phosphate, gypsum | trace | trace |
| Mica | 0 | 5-30 |

TABLE 2

X-ray diffraction measurements in three Eagle Ford Shale wells

| Mineral | Average weight (%) | Range (%) |
|---|---|---|
| Chlorite | 0.95 | 0-8 |
| Kaolinite | 4.27 | 0-23 |
| Illite | 6.32 | 0-20 |
| Mixed Illite/Smectite | 8.87 | 0-67 |
| Calcite | 56.67 | 2-95 |
| Dolomite | 1.99 | 0-45 |
| Quartz | 12.51 | 2-29 |
| K-feldspar | 1.28 | 0-8 |
| Plagioclase | 2.75 | 0-29 |
| Pyrite | 4.54 | 0-36 |
| Siderite | 0.06 | 0-1 |
| Marcasite | 0.05 | 0-2 |
| Apatite | 0.24 | 0-5 |

Figure 3:
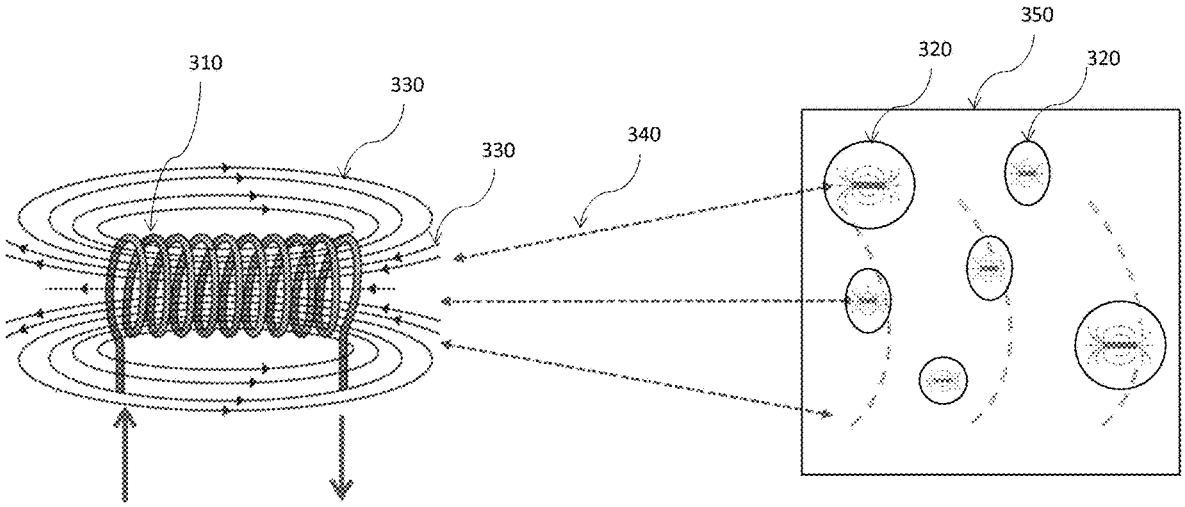
FIG. 3 illustrates a simplified model for estimating the forces between an electromagnet and magnetic particles, in some embodiments.

FIG. 3 illustrates a simplified model for estimating the forces between an electromagnet 310 and magnetic particles 320 in rock formation 350. In FIG. 3, a time-varying current 313 is supplied to electromagnet 310 to generate a time-varying magnetic field 330. Pyrite, siderite and iron magnetic particles 320 in rock formations 350 become magnets when activated by external magnetic field 330, in accordance with some embodiments. The magnetic forces between electromagnet 310 and a magnetic particle 320 can be approximated by Equation 2 below:

$$F = \frac{\mu m_1 m_2}{4\pi r^2} \tag{2}$$

where μ is the magnetic permeability of the intervening medium between electromagnet 310 and magnetic particle 320, r is the distance between electromagnet 310 and magnetic particle 320, and $m_1$ and $m_2$ are the magnitudes of magnetic poles for electromagnet 310 and magnetic particle 320, respectively. Skilled artisans will appreciate that magnetic field 330 may be determined by factors such as the amplitude and direction of the current supplied to electromagnet 310, and the number of turns for the coils of electromagnet 310. By supplying a time-varying current to electromagnet 310 (e.g., current with varying magnitudes and directions), a time-varying electromagnetic field could be generated, which in turn exerts a time-varying magnetic force (e.g., attracting and repelling forces) on magnetic particles 320. Other parameters may affect the response of magnetic particles 320 to magnetic field 330. For example, the susceptibility of magnetic crystals, the size distribution of magnetic particles, and the volumetric distribution of magnetic particles may affect how magnetic particles 320 respond to the time-varying magnetic field 330. Therefore, Equation 2 only provides an estimate of the magnetic force based on a simplified model. One skilled in the art will appreciate that more complicated models, sometime coupled with actual measurements, may be needed to obtain an accurate description of the magnetic field and magnetic force.

Figure 4:
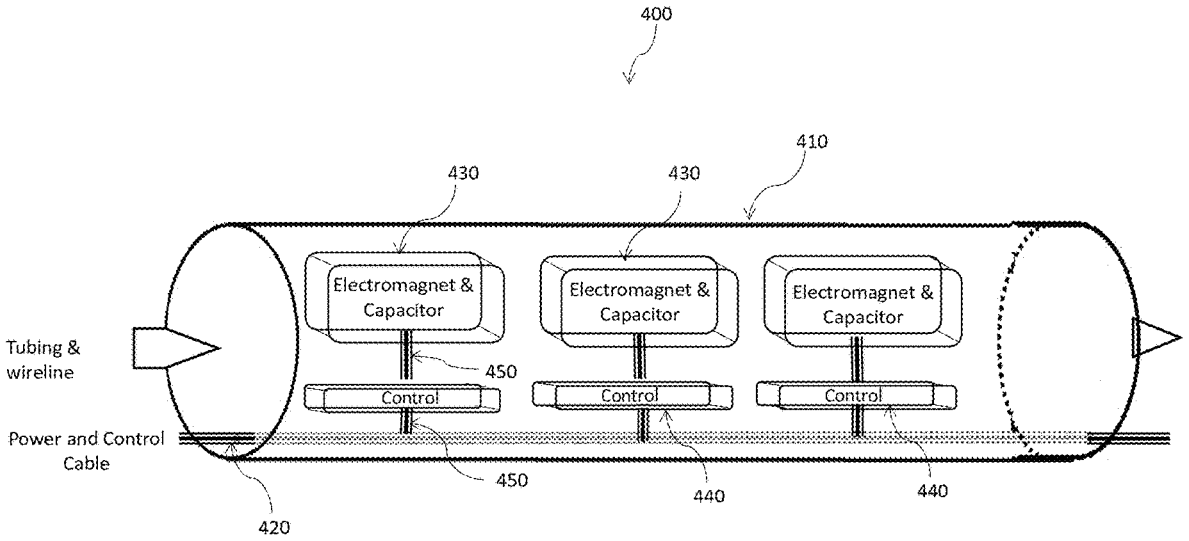
FIG. 4 illustrates an electromagnetic tool in accordance with an embodiment of the present disclosure.

FIG. 4 illustrates an electromagnetic tool 400 in accordance with an embodiment of the current disclosure. As illustrated in FIG. 4, tool 400 includes a housing 410. Housing 410 has a tube shape and is made of a non-magnetic material, in some embodiments. Electromagnetic tool 400 may be attached to other existing down-hole tools to form a down-hole tool string. Therefore, the diameter of housing 410 may be the same or similar to the diameter of other down-hole tools in the tool string, although other sizes may be possible. In other embodiments, electromagnetic tool 400 may be used alone as the down-hole tool. Electromagnetic tool 400 may have connectors (not shown) on one or both ends of the tube-shaped housing 410 for connection with other down-hole tools or pipes. Inside housing 410, cable 420 are connected to cables in adjacent down-hole tools or pipes. Cable 420 may supply power to electromagnetic tool 400. Cable 420 may also carrier control and/or data signals for communication with, e.g., a system control computer (see FIG. 7) located above ground. Cable 420 may include one physical cable, or may alternatively include more than one physical cable. Cable 420 may also be referred to as power and control cable 420.

As shown in FIG. 4, one or more electromagnets 430 are electrically connected to cable 420 via internal cables/connectors 450. Skilled artisans will appreciate that each electromagnet 430 may include a coil wrapped around a core made of ferromagnetic material(s). Electromagnets 430 provide the time-varying magnetic field, in various embodiments. Each electromagnet 430 may further include one or more capacitors coupled in parallel to the electromagnet. The capacitors may provide a surge of magnetic field strength for electromagnet 430. For example, power and control cable 420 may only provide limited current driving capability, therefore it may be difficult to create a strong electromagnetic field for all electromagnets 430 at the same time. The capacitors provide the flexibility to store electric charge over a certain period of time, and then the charge stored in the capacitor can be released in a short time period by, e.g., a control switch, to provide a surge of magnetic field strength. In some embodiments, the capacitor and the coil in electromagnets 430 are tuned to resonance. For example, the capacitance of the capacitor and the inductance of the coil are tuned to be equal. This permits rapid response time, thereby allowing magnetic pulses with fast rise time (e.g., from 1 ms to 30 ms) to be generated. For a given electric current value, a fast rise time advantageously exerts a stronger magnetic force on magnetic particles, thus improving the effectiveness of the electromagnetic tool 400.

As shown in FIG. 4, a control unit 440 is coupled between power and control cable 420 and electromagnet 430. Control unit 440 may be or include one or more semiconductor switches, although other types of suitable switches may also be used. In some embodiments, each control unit 440 in electromagnetic tool 400 is individually addressable (e.g., having a unique device address), and has circuits configured to communicate with and respond to a system control computer (see FIG. 7) located remotely (e.g., above ground). The system control computer may control the operation of electromagnets 430 by controlling the operation of control unit 440 via control signals sent over power and control cable 420. The control signals may contain coded instructions from the system control computer, and the coded instructions may contain information regarding, e.g., reversal of the direction of the electric current, electric current pulse width, electrical current repetition rate (e.g., switching frequency), and pause period (e.g., no electrical current). Therefore, information contained in the coded instruction may be used to change various aspects of the electromagnetic fields generated by electromagnets 430. In the description below, electromagnetic fields with one or more aspects changed may be referred to as different electromagnetic fields. The coded instructions may include addresses for one or more control units 440. The coded instructions may be formed by assembling or mapping the information to be transmitted in accordance with a pre-determined encoding method. The resulting coded instructions may have predetermined structure and length (e.g., a frame structure as used in digital communication), as skilled artisan will readily appreciate.

Once control unit 440 receives a code instruction with a matching address, control unit 440 performs the corresponding functions specified by the coded instruction, in some embodiments. The system control computer may instruct one or more control units 440 to perform certain functions individually, synchronously, or asynchronously, according to a pre-determined fashion to increase the effectiveness of electromagnetic tool 400, in some embodiments. For example, the system control computer may instruct each electromagnet 430 (e.g., by controlling control units 440) in an electromagnetic tools 400 to generate a different electromagnetic field. As another example, as electromagnetic tool 400 is moved from a first location in the well bore to a second location, the system control computer may instruct each electromagnet 430 (e.g., by controlling control units 440) to generate an second electromagnetic field at the second location that is different from a first electromagnetic field generated at the first location. Other ways for controlling electromagnets 430 to generate different electromagnetic fields are possible and are within the scope of the present disclosure. The flexibility in controlling each electromagnet 430 individually may advantageously increase the effectiveness of electromagnetic tool 400, since different patterns of electromagnetic fields can be designed and applied to match different rock formations, thereby maximizing the efficacy of increasing the permeability of rock formations.

In some embodiments, the time-varying electromagnetic field is generated by electromagnetic tool 400. Electromagnetic tool 400 may be located in or near the rock formations where micro fractures are to be generated, e.g., in a section of the well bore in the production zone. The time-varying electromagnetic field penetrates at least a portion to the rock formation (e.g., rock formations adjacent to the electromagnetic tool), and applies time-varying magnetic forces to susceptible magnetic particles in the rock formation. For example, a time-varying current could be supplied to electromagnetic tool 400 to generate a time-varying electromagnetic field, e.g., a magnetic field that changes polarities alternately, thereby applying time-varying magnetic forces (e.g., reciprocating attracting and repelling forces, see more details in discussion with reference to FIG. 8) on magnetic particles of the rock formations. In some embodiments, the magnetic particles are part of the fixed structures of rock formations and are not loose particles, or particles dissolved or floating in formation fluids within the rock formation. The fixed structures may be the pore structures in rock formations. Therefore, the magnetic particles are immobile (e.g., not movable by the flow of fluids) before the time-varying magnetic field and the resulting time-varying magnetic forces are applied, in various embodiments. Due to the time-varying electromagnetic forces, the magnetic particles are dislodged or separated from the fixed structures of rock formations, with or without other particles or formation structures adjacent to, or attached to, the magnetic particles in the original fixed structures of rock formations. Dislodging or separating magnetic particles thereby causes micro fractures in the rock formations (e.g., pore structures), in accordance with some embodiments. The pore structures (e.g., pore throat sizes and connectivity between pores) are therefore modified by the time-varying electromagnetic forces, in various embodiments. After electromagnetic tool induces micro fractures at one location, it may be moved to a second location to improve the permeability of rock formations around the second location. In some embodiments, multiple electromagnet tools 400 may be attached together to cover a longer span of rock formations for improved efficiency. Although a time-varying electromagnetic field is used in the example above, a constant magnetic field (e.g., a constant electromagnetic field) may be used for increasing the permeability of rock formations and is contemplated within the scope of the present disclosure.

Without being limited to any particular theory of operation, it is believed that the micro fractures increase pore throat sizes of the pore structures. Micro fractures may also increase the connectivity between different pores. Increased pore throat sizes and/or increased connectivity between pores improve the permeability of rock formations. In some embodiments, the time-varying magnetic forces may slightly change the positions of the magnetic particles in the rock formations, thereby affecting how particles are packed together. For example, the time-varying magnetic forces may loosen up the magnetic particles so they are not packed tightly together, thus changing the permeability (e.g., increase permeability) of the rock formation.

The exemplary electromagnetic tool 400 has many advantages. By increasing the permeability of oil bearing formations, electromagnetic tool 400 unlocks large percentages of oil locked in place by low-permeability formations. Oil bearing formations previously deemed economically unviable for oil extraction due to low permeability can now be improved by the tools and methods disclosed in the current disclosure to become economically viable. In addition, electromagnetic tool 400 can be used to improve the recovery rate of existing wells. Typically, once a well is drilled, the production of oil (e.g., flow rate) peaks within a few months, then production declines until it becomes economically unviable to continue the oil recovery operation. By treating existing wells with electromagnetic tool 400, oil recovery rate can be increased, and wells can be operated more productively (e.g., higher flow rate) for longer time. Previously abandoned wells may also be treated with electromagnetic tool 400 and become profitable to resume oil recovery operation. Electromagnetic tool 400 does not need water to operate, which saves natural resources and is environmentally safe (e.g., no fracking fluids used).

Electromagnets and magnetic fields have been used in oil production previously. However, none of the existing methods attempted to improve permeability, especially at the micrometer or nanometer level by inducing micro fractures in rock formations. Instead, the use of magnetic field previously was mostly limited to removing loose magnetic particles floating in formation fluid, but not to change pore structures and permeability. For example, in U.S. Pat. No. 5,323,855, magnetic field was used to attract loose magnetic particles floating in formation liquid toward well bore. As the loose magnetic particles move toward well bore, they drag oil along with them, thus increasing oil flow toward the well bore. In U.S. Pat. No. 6,499,536, magnetic materials were injected through oil well into oil reservoir. Vibration of the injected magnetic materials is induced by magnetic field. The vibration reduces surface tension of the oil in the reservoir, thus increasing oil glow. However, the injected magnetic materials are not part of the pore structures, and there was no attempt to increase the permeability of rock formations.

Figure 5:
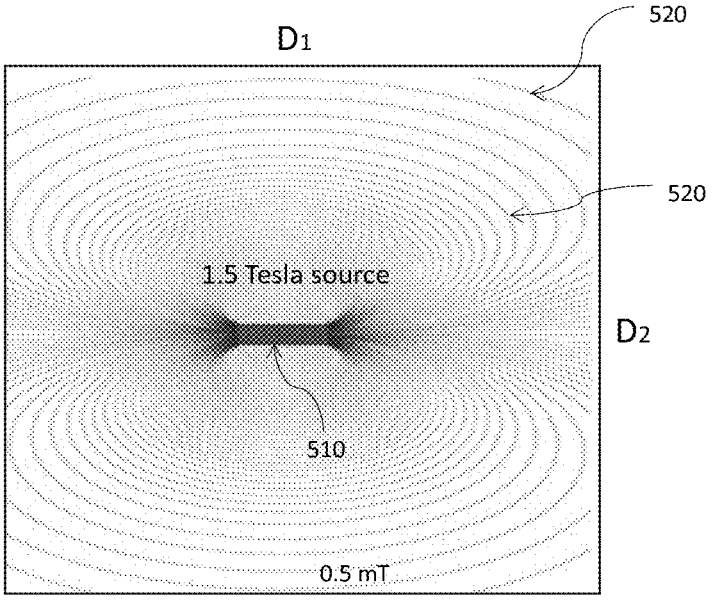
FIG. 5 illustrates the magnetic field generated by the electromagnetic tool shown FIG. 4, in some embodiments.

FIG. 5 illustrates the magnetic field 520 generated by electromagnetic tool 510. To maximize the effectiveness of electromagnetic tool 510, it is desirable to have a magnetic field 520 that have a large coverage area around electromagnetic tool 510, so that permeability in large areas of rock formations around electromagnetic tool 510 can be improved, in some embodiments. The coverage area is a three-dimensional area surrounding electromagnetic tool 510, with each dimension having a size in a range from, e.g., a few meters to about tens of meters. Magnetic field within the coverage area should be maintained above a pre-determined minimum threshold, so that rock formations within the coverage area can be effectively fractured at a micrometer or nanometer level to improve the permeability of the formations. Strength of magnetic field at a particular location is usually inversely proportional to the distance between the location and the electromagnetic tool. Therefore, in some applications, it is convenient to specify the coverage area of magnetic field 520 by the size of the coverage area and the strength of magnetic field at the perimeters of the coverage area. Note that the design criteria for magnetic field 520 may be different from magnetic fields used in laboratory environment, medical environment, or industrial environment, where the focus is on the near-field strength (e.g., strength of magnetic field inside and/or next to the coil of the electromagnet), and where it may be desirable to limit the magnetic field to a specified narrow target region (e.g., for medical imaging purpose). In contrast, for the electromagnetic tool of the current disclosure, the focus is on far-field strength (e.g., strength of magnetic field away from the electromagnet), and it is desirable to have a wide coverage area for the magnetic field, in accordance with some embodiments.

The strength of magnetic field generated by an electromagnet can be approximated by $$S = \frac{K * \mu_0 * N * I}{L} \tag{3}$$

where N is the number of turns of the coil, I is the current, L is the length of the magnetic core of the electromagnet, K is relative permeability, and $\mu_0 = 4*\pi*10^{-7}$ is a constant.

Table 3 shows the magnetic field strength at the core of electromagnet (also referred to as source flux density) for different input currents. The source flux density in Table 3 is calculated using equation (3) for different current values I, with N=1000, K=200, L=0.1. For example, with an input current of 0.6 A, a 1.5 tesla source flux density is obtained. Higher magnetic field strength could be achieved by, e.g., supplying a higher current to the electromagnet. An example is given below in FIG. 6 to estimate the coverage area of the electromagnet tool of the current disclosure.

TABLE 3

Source flux density for different current values

| I (Amps) | S (telsa) |
|---|---|
| 0.6 | 1.5 |
| 0.8 | 2.0 |
| 1.0 | 2.5 |
| 1.2 | 3.0 |

Figure 6:
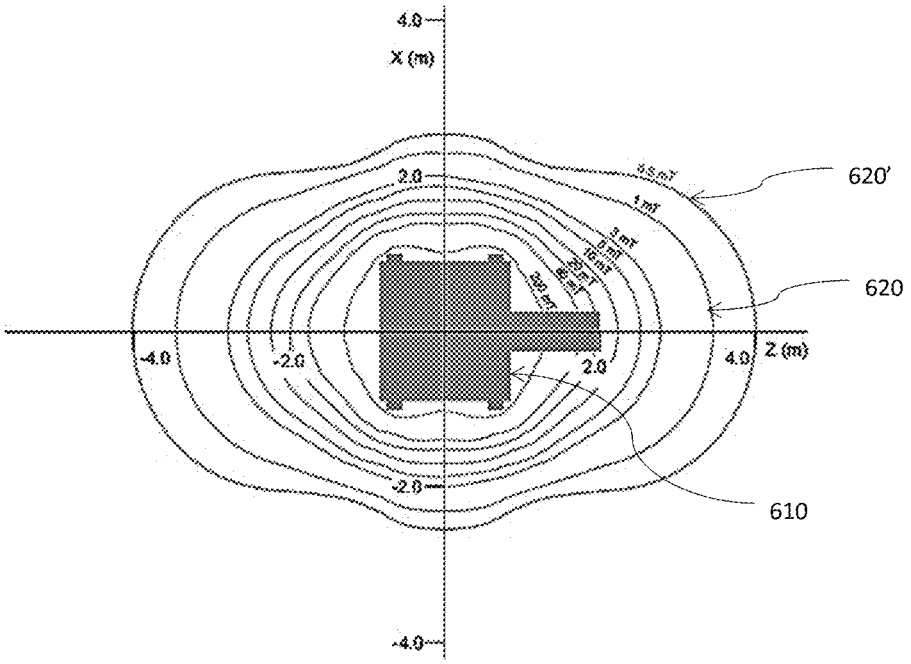
FIG. 6 illustrates the contour plots of measured magnetic field strength around a magnetic resonance imaging device.

FIG. 6 illustrates the strength of magnetic field around a magnetic resonance imaging (MRI) machine 610. MRI machines can achieve source flux density of 1.5 tesla or higher, thus may server as a reference for estimating the coverage area of the electromagnetic tool of the present disclosure. In the example of FIG. 6, the source flux density of MRC machine 610 is 1.5 tesla. Shielding is provided to MRI machines 610 to limit the strength of magnetic field (sometimes referred to as flux density) surrounding the MRI machines for safety reasons. Measurements of the flux density at different location are taken, and locations with the same flux density form a contour line 620 around MRI machine 610. As shown in FIG. 6 by contour curve 620, a magnetic field strength of 0.5 millitesla (mT) is measured in an area having a size of 6×8 meters around MRI machine 610. The shielding of MRI machine provides about 3 times reduction of the strength of magnetic field. For oil production, no shielding is needed for the electromagnet tool, since it operates thousands of feet underground. Therefore, an electromagnetic tool of the present disclosure with a 1.5 tesla source flux density could have a coverage area with size about 18×24 meters, with a magnetic field strength of 0.5 mT at the perimeters of the coverage area. The size of the coverage area and the strength of magnetic field discussed above is an illustrative example only. One skilled in the art will appreciate that other coverage area sizes and/or other magnetic field strengths are possible. For example, one could obtain higher strength of magnetic field by using higher current, and/or using more turns for the coils of the electromagnetic tool.

Figure 7:
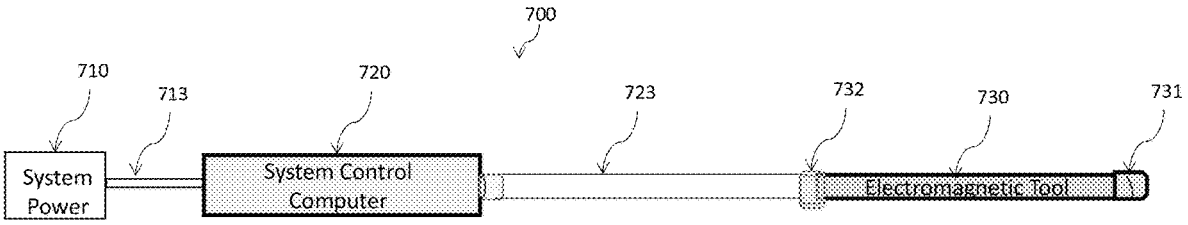
FIG. 7 illustrates a system for improving the permeability of rock formations, in accordance with some embodiments of the present disclosure.

FIG. 7 illustrates a system 700 for improving the permeability of source rocks, in accordance with some embodiments of the present disclosure. System 700 includes system power unit 710, cables 713, system control unit 720, and electromagnetic tool 730, in various embodiments. System 700 may also include other components 723 connected between system control unit 720 and electromagnetic tool 730. For example, components 723 may be a plurality of pipes 723. Each pipe 723 has cable(s) (not shown) inside for transmitting power and data signals, and pipes 723 are concatenated to form a string of pipes extending from the surface to the production zone of the oil bearing strata, in some embodiments. Electromagnetic tool 730 may be physically and electrically connected to an adjacent pipe 723 at a first end 732. In other embodiments, component 723 adjacent to electromagnetic tool 730 is another down-hole tool instead of a pipe. Although not shown in FIG. 7, other down-hole tools could be connected down-stream (e.g., further away from system control unit 720) of electromagnetic tool 730 at a second end 731.

System power unit 710 supplies power to system 700. System control unit 720, also referred to as system control computer 720 or control computer 720, is located above ground (e.g., in an operation control room) and powered by system power unit 710 via cable 713, in some embodiments. System control unit 720 may be a computer equipped with hardware for controlling and communicating with down-hole tools such as electromagnetic tool 730 and/or other down-hole tools, although other suitable control units could also be used. Specialized software may be installed on system control unit 720 to monitor and control the operation of system 700. Skilled artisans will appreciate that software may include any computer executable code, including driver, firmware, operating system (OS), as examples. System control unit 720 may also have a display unit and an input unit (e.g., keyboard, mouse), so that a human operator can monitor and input commands to system control unit 720 to control the operation of system 700. Electromagnetic tool 730 may have the same or similar structure as electromagnetic tool 400 illustrated in FIG. 4. By controlling the current flowing through the coil(s) of electromagnetic tool 730, system control unit 720 controls the time-varying magnetic field generated by electromagnetic tool 730, in accordance with some embodiments.

Figure 8:
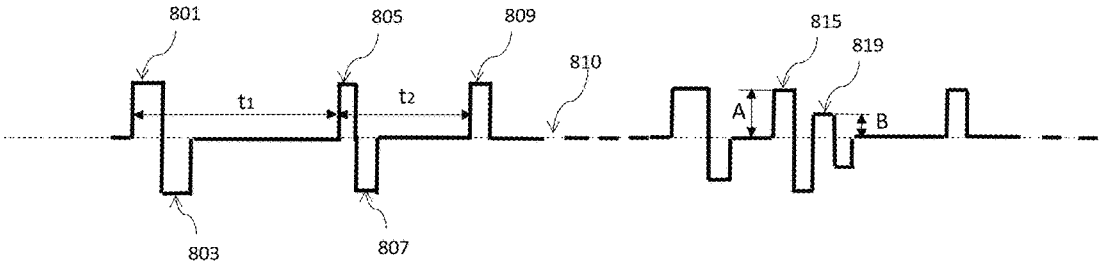
FIG. 8 illustrates a time-varying current flowing through the coil(s) of an electromagnetic tool over a period of time, in some embodiments.

FIG. 8 illustrates an example of the current flowing through the coil(s) of electromagnetic tool 730 over a period of time. A plurality of current pulses, e.g., pulses 801, 803, 805, 809, 815 and 819 are shown in FIG. 8. A positive current value (e.g., pulse 801) indicates current flow in a first direction, and a negative current value (e.g., pulse 803) indicates current flow in a second direction opposite the first direction. Switching the direction of current causes the polarity of the magnetic field to change, as one skilled in the art readily appreciates. Therefore, a magnetic field generated by a positive current pulse followed by a negative current pulse (or vice versa) applies a time-varying magnetic force to magnetic particles in rock formations, for example, an attracting-and-repelling magnetic force to, e.g., permanent magnetic particles in rock formations, or an attracting-and-release force to, e.g., paramagnetic particles in rock formations. The strength of the magnetic field is proportional to the amplitude of current, thus different strength of magnetic field could be achieved by varying the amplitudes of current pulses. For example, pulse 815 has amplitude A, while pulse 819 has amplitude B.

As illustrated in FIG. 8, duration of each pulse could be changed. For example, pulses 801 and 805 have different durations. In addition, the intervals (e.g., $t_1$ and $t_2$) between pulses can be changed to control the switching frequency of the magnetic field. Different combinations of current pulse are possible. For example, pulses 801, 803, 805 and 807 form a repetitive pattern of a positive pulse followed by a negative pulse. As another example, positive pulses and negative pulses may not always appear in pair (e.g., a pair of pulses 801 and 803). Instead, a single pulse (e.g., pulse 809) may be generated. In addition, system control computer may pause the generation of current pulses for a period of time (e.g., period 810). A period of pause may be used by system control computer 720 to process collected data, or to wait for data and/or acknowledgement signal from the down-hole tools. Skilled artisans will readily recognize more combinations of current pulses, all of which are contemplated within the scope of the current disclosure.

In some embodiments, the magnetic field generated by electromagnetic tool 730 switches polarity alternately, resulting in a repetitive pattern of forces (e.g., attracting-and-repelling magnetic forces, or attracting-and-release magnetic forces). The frequency at which the repetitive pattern of attracting and repelling forces occurs is referred to as the switching frequency of the magnetic field. In some embodiments, the switching frequency of the magnetic field may be chosen to be the same or similar to the resonance frequency of the rock formations. When the switch frequency matches the resonance frequency of the rock formations, effectiveness of magnetic tool 730 may be maximized since more micro fractures may occur in the rock formations, thereby achieving larger permeability. In other embodiments, a "frequency sweep" operation is performed where current pulses gradually and continuously change switching frequency from a first frequency to a second frequency. The first frequency and the second frequency may be chosen to cover a frequency range that includes the resonance frequency of the rock formations. Depending on the composition and structure of the rock formations, one or more resonance frequencies may exist for different portions of the rock formation. In addition, it may not be feasible to know the exact resonance frequency of the rock formations at a particular location thousands of feet underground. The "frequency sweep" operation described above may thus be advantageously performed to cover a range of resonance frequencies that are likely to include the resonance frequency of the portion of rock formations near the electromagnetic tool. Although pulses are illustrated as having a rectangle shape (e.g., a step function) in FIG. 8, other shapes of current pulses, e.g., current pulses having sinusoidal shapes, could be used. Skilled artisans will appreciate that the discussion above regarding current pulses could be readily applied to current pulses with other shapes (e.g., sinusoidal shapes).

Figure 9:
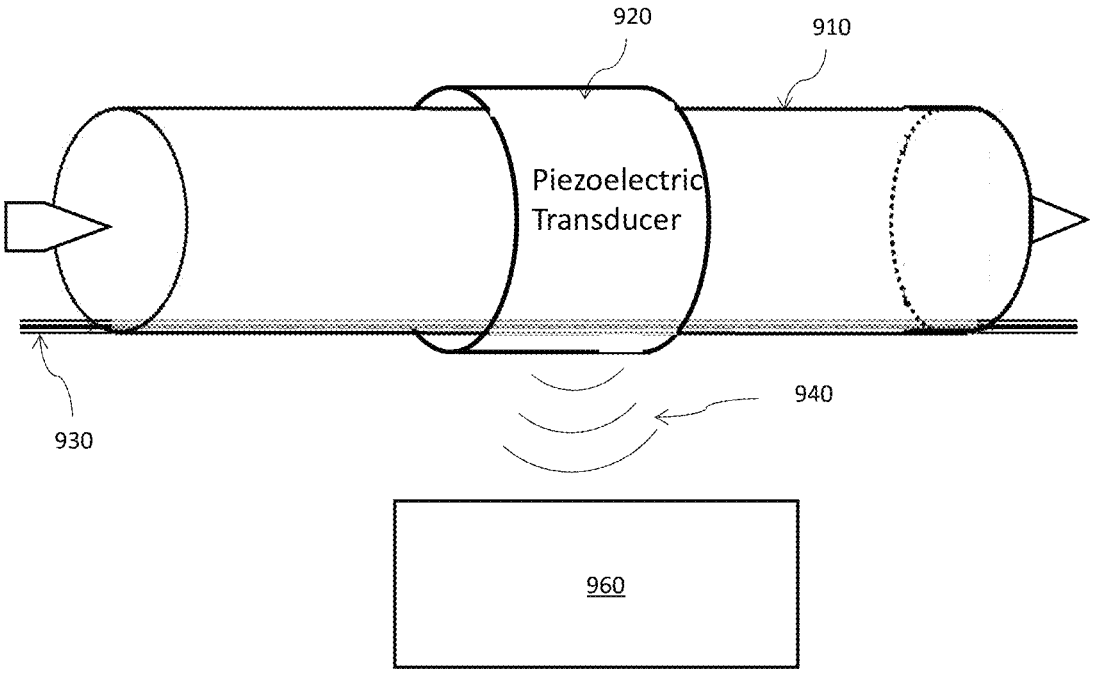
FIG. 9 illustrates a pressure wave generating tool, in some embodiments.
Figure 10:
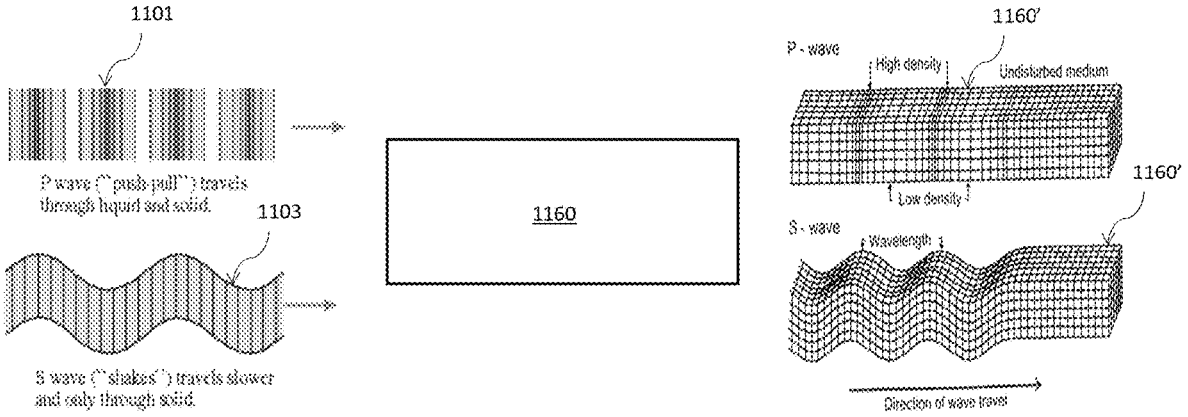
FIG. 10 illustrates the distortion of geological formations by pressure waves, in some embodiments.

FIG. 9 illustrates a pressure wave generating tool for improving the permeability of rock formations, in some embodiments. The pressure generating tool includes a pressure wave generating device, e.g., a piezoelectric transducer 920 coupled to cable 930. Cable 930 may carrier power and data signal, similar to cable 420 in FIG. 4. In FIG. 9, piezoelectric transducer 920 is illustrated as being located outside tube 910. In other embodiments, piezoelectric transducer 920 is located inside tube 910. As illustrated in FIG. 9, when a time-varying voltage is applied to piezoelectric transducer 920, piezoelectric transducer 920 vibrates in response to the time-varying voltage, sending pressure waves 940 to rock formations 960. The pressure wave 940 may apply compressive and expansive forces to rock formations 960. For example, FIG. 10 illustrates the distortion of geological formations 1160 by primary wave (P-wave) 1101 and secondary wave (S-wave) 1103. Distorted formations are labeled as 1160' in FIG. 10. In some embodiments, the compressive and expansive forces cause micro fractures in and/around pore structures in the rock formations, which micro fractures may increase pore throat sizes and/or connectivity between pores, resulting in increased permeability of rock formations. The pressure wave generating tool in FIG. 9 does not require added water to operate. For example, the well bore may already have formation water disposed therein, the pressure wave generated by the pressure wave generating tool may propagate through the formation water and into source rocks. In some embodiments, the impedance of the piezoelectric transducer 920 may be designed to substantially match the impedance of the channel of the pressure wave (e.g., formation water) to maximize energy transfer of the piezoelectric transducer. Piezoelectric transducers are used as an example for the pressure wave generating device in the pressure wave generating tool illustrated in FIG. 9, other suitable pressure wave generating devices may also be used and are within the scope of the present disclosure.

Similar to the discussion of electromagnetic tool 730, the switching frequency (e.g., the frequency at which repetitive pattern of compressive and expansive forces occurs) of the pressure wave may be chosen to be the same or similar to the resonance frequency of the rocket formations. In other embodiments, a frequency-sweep operation may be performed to generate compressive and expansive pressure forces with switching frequency that gradually and continuously changes within a frequency range. The frequency range may include resonance frequency of the rock formations near the pressure wave generating tool. The pressure generating device illustrated in FIG. 9 may be used together with the electromagnetic tool (e.g., electromagnetic tool 730) in some oil recovery operations. Alternatively, the pressure wave generating tool may be used without the electromagnetic tool (e.g., electromagnetic tool 730). After fracturing rock formation at a first location, the pressure wave generating tool may be moved to a second location and used to improve permeability of rock formations around the second location, in various embodiments.

Figure 11:
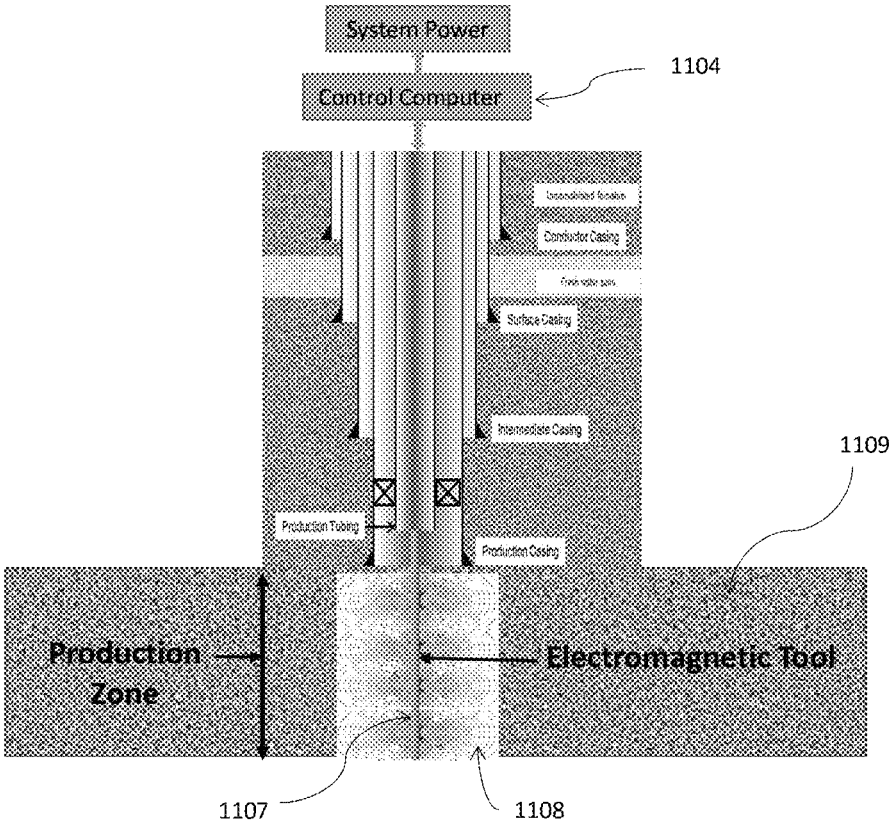
FIGS. 11-14 illustrate different scenarios the electromagnetic tool is used for oil recovery, in various embodiments.

FIGS. 11 to 14 illustrate different scenarios the electromagnetic tool is used in oil production. In FIG. 11, electromagnetic tool 1107 is positioned in a vertical well bore in production zone 1109. Control computer 1104 controls the current flowing through electromagnetic tool 1107, and a time-varying magnetic field 1108 is generated around electromagnetic tool 1107. The time-varying magnetic field 1108 applies time-varying magnetic forces to magnetic particles in rock formations, causing micro fractures and increasing permeability of the rock formations, resulting in improved oil recovery rate.

Figure 12:
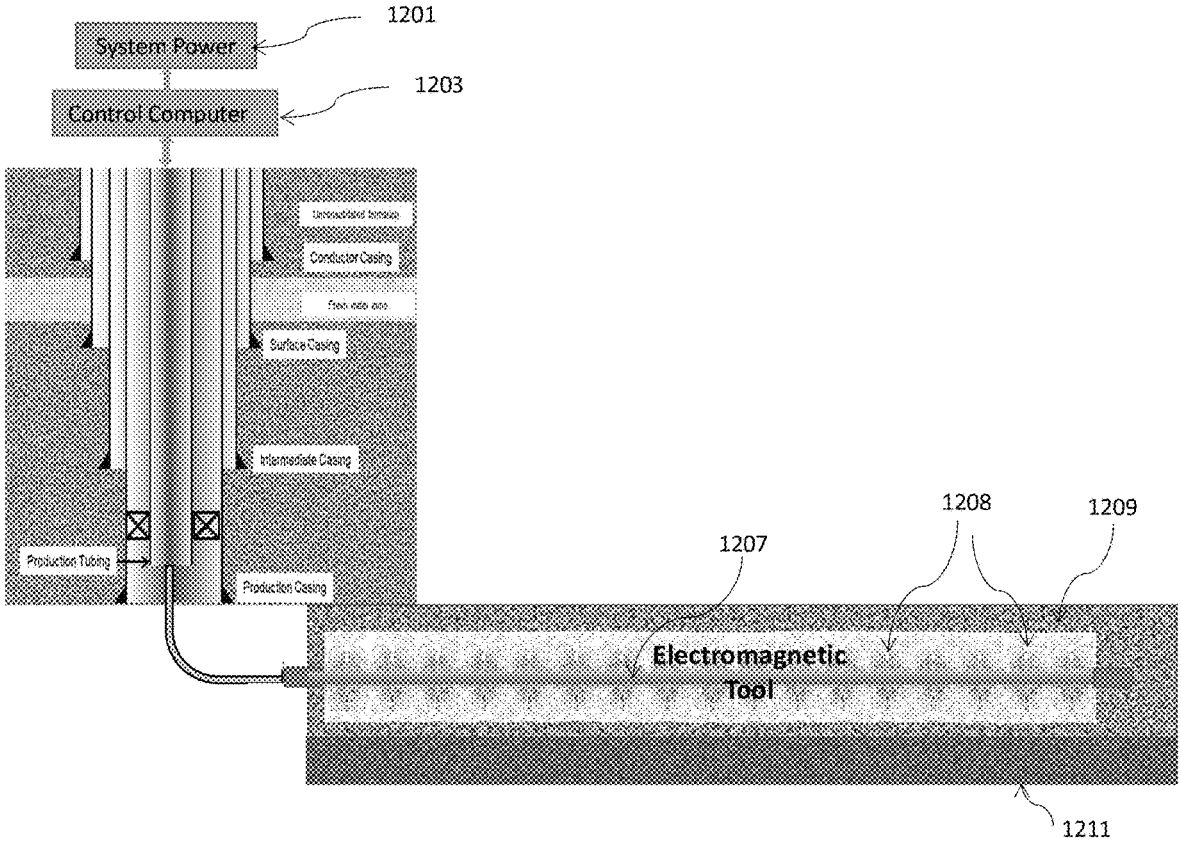

FIG. 12 illustrates electromagnetic tool 1207 being positioned in a horizontal well bore in production zone 1209. A time-varying magnetic field 1208 is generated by electromagnetic tool 1207 to induce micro fractures in the rock formation around electromagnetic tool 1207. Since electromagnetic tool 1207 induces micro fractures, it could be used safely to improve the permeability of rock formations without concerns of puncturing and contaminating other formations next to the product zone. As an example, FIG. 12 illustrates a sensitive formation 1211 next to production zone 1209. Sensitive formation 1211 may contain underground water reservoirs, or may be a barrier to underground water reservoirs. Traditional hydraulic fracturing may not able to operate in these types of geological formations, whereas the electromagnetic tool 1207 can be safely operated for such geological formations. In addition, fracking operations inject fracking fluid underground, which may be an environmental concern. The electromagnetic tool of the current disclosure does not require water or fracking fluids for operation. This illustrates another advantage of the present disclosure.

Figure 13:
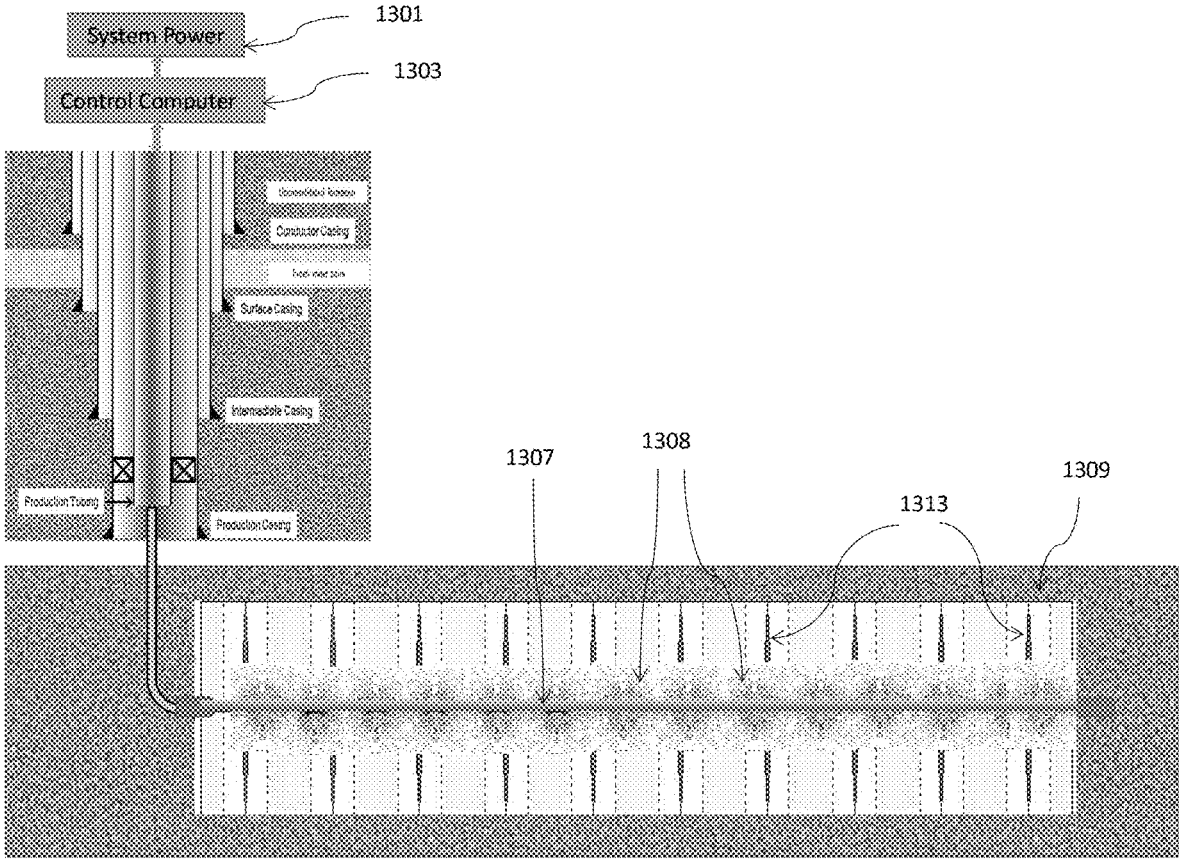

FIG. 13 illustrates electromagnetic tool 1307 being used in a horizontal well bore to treat rock formations in the production zone 1309, after fracking has been performed. Fractures 1313 illustrate the macro fractures resulting from the fracking operation. Electromagnetic tool 1307 generates a time-varying magnetic field 1308 to induce micro fractures in the rock formations, thereby improving permeability of the rock formations. Oil flows into fractures 1313 increases due to higher permeability, resulting in increased oil recovery rate.

Figure 14:
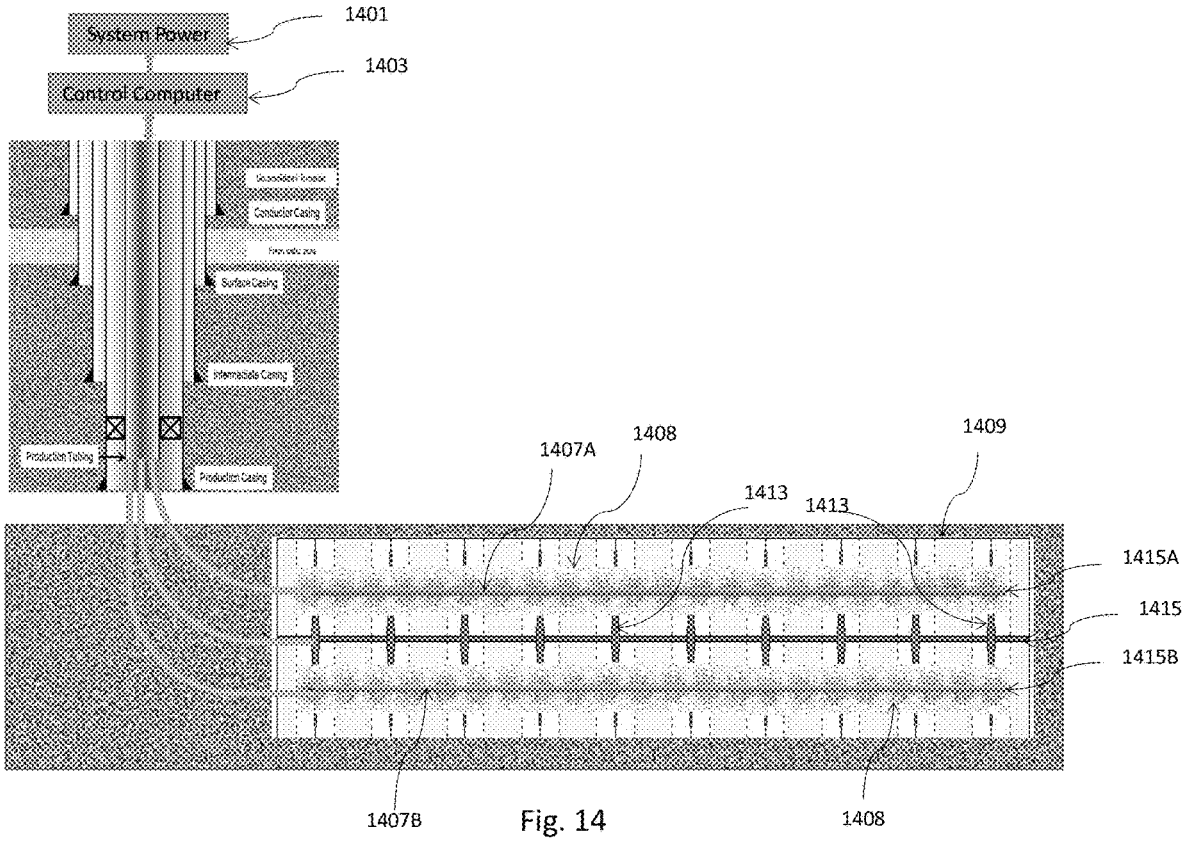

FIG. 14 illustrates another example, where two electromagnetic tools 1407A and 1407B are used to treat production zone 1409, after fracking has been performed using well bore 1415. Two additional horizontal well bores 1415A and 1415B are formed substantially in parallel to well bore 1415. Each electromagnetic tool (e.g., 1407A or 1407B) performs similar functions as those described for electromagnetic tool 1307 in FIG. 13. Due to the use of two electromagnetic tools, more portions of oil bearing formations are treated to increase the permeability, and consequently, more oil could flow into macro fractures 1413 (caused by the fracking operation) and into well bore, resulting in increased oil recovery rate.

Figure 15:
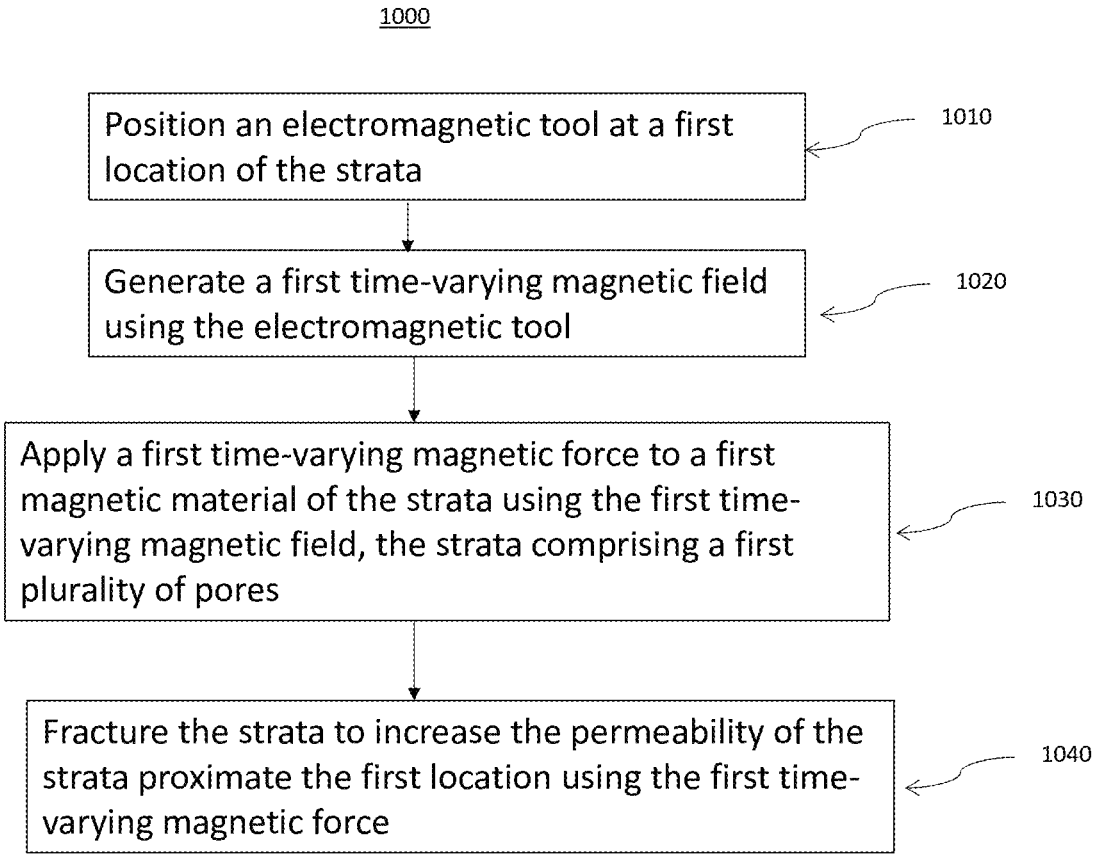
FIG. 15 illustrates a flow chart for an exemplary method disclosed herein.

FIG. 15 illustrates a flow chart of a method of increasing a permeability of a strata, in accordance with some embodiments. It should be understood that the embodiment methods shown in FIG. 15 is an example of many possible embodiment methods. One of ordinary skill in the art would recognize many variations, alternatives, and modifications. For example, various steps as illustrated in FIG. 15 may be added, removed, replaced, rearranged and repeated.

Referring to FIG. 15. At step 1010, an electromagnetic tool is positioned at a first location of the strata. At step 1020, a first time-varying magnetic field is generated using the electromagnetic tool. At step 1030, a first time-varying magnetic force is applied to a first magnetic material of the strata using the first time-varying magnetic field. The strata includes a first plurality of pores. At step 1040, the strata is fractured to increase the permeability of the strata proximate the first location using the first time-varying magnetic force.

Advantages of embodiment systems and methods include increase oil recovery rate. By increasing the permeability of oil bearing formations, oil flow increase, resulting in improved oil recovery rate. Previously economically unviable oil bearing formations can become economically viable for oil extraction. Existing wells can be treated using the disclosed tools and methods to improve production and lengthen the life of the wells. This represents a significant increase of return for the capital investment related to oil exploration and extraction. In addition, the disclosed tools and methods do not need added water to operate, and are environmentally friendly.

In accordance with an embodiment, a method of increasing a permeability of a strata includes positioning an electromagnetic tool at a first location of the strata, generating a first time-varying magnetic field using the electromagnetic tool, and applying a first time-varying magnetic force to a first magnetic material of the strata using the first time-varying magnetic field, where the strata includes a first plurality of pores. The method further includes fracturing the strata to increase the permeability of the strata using the first time-varying magnetic force.

In other embodiments, a method of recovering hydrocarbon fuels includes positioning an electromagnetic tool at a first position of a bore hole, applying a first electromagnetic force to a first source rock proximate the electromagnetic tool, where the first electromagnetic force fractures the first source rock and increases a permeability of the first source rock. The method further includes moving the electromagnetic tool to a second position of the bore hole, and applying a second electromagnetic force to a second source rock proximate the electromagnetic tool, wherein the second electromagnetic force fractures the second source rock and increases a permeability of the second source rock.

In yet other embodiments, a system for increasing a permeability of a strata includes a surface system control unit, one or more cables transmitting electrical power and control signals, and a down-hole tool unit connected to the surface system control unit by the one or more cables. The down-hole tool unit includes a non-magnetic housing, a plurality of coils around a magnetic core disposed in the non-magnetic housing, a capacitor coupled to the plurality of coils, and a control circuit. The down-hole tool unit is configured to alternately apply an electromagnetic attracting force and an electromagnetic repelling force to a rock formation proximate the down-hole tool unit using a time-varying magnetic field generated by the down-hole tool unit, where the electromagnetic attracting force and the electromagnetic repelling force fracture the rock formation and increase a permeability of the rock formation.

In some embodiments, a system for recovering carbon fuel includes a surface control unit and a down-hole tool unit connected to the surface control unit. The down-hole tool unit includes a first electromagnet and a first control unit electrically coupled to the first electromagnet, where the down-hole tool unit is configured to generate a time-varying electromagnetic field, and to apply a time-varying magnetic force to a rock formation within a coverage area of the down-hole tool unit using the time-varying electromagnetic field, where the time-varying electromagnetic field within the coverage area is above a pre-determined threshold for fracturing the rock formation.

In some embodiments, an electromagnetic tool for increasing a permeability of a strata includes a electromagnet having a coil, a capacitor coupled to the electromagnet, and a control unit coupled to the electromagnet and the capacitor, where the electromagnetic tool is configured to generate an electromagnetic field within a coverage area of the electromagnetic tool, where the electromagnetic field within the coverage area is above a threshold for fracturing the strata.

In some embodiments, a method includes positioning an electromagnetic tool at a first location of a well bore, generating a first time-varying magnetic field using the electromagnetic tool, a strength of the first time-varying magnetic field in a coverage area of the electromagnetic tool being above a pre-determined threshold for fracturing a first rock formation proximate the first location, and applying a first time-varying magnetic force to the first rock formation using the first time-varying magnetic field.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A system for increasing permeability of source rocks, the system comprising:

a surface control unit; and a down-hole tool unit electrically coupled to the surface control unit, the down-hole tool unit comprising an electromagnet, wherein the down-hole tool unit is configured to generate a time-varying electromagnetic field using the electromagnet, and configured to fracture a rock formation within a coverage area of the down-hole tool unit by applying a time-varying magnetic force to the rock formation through the time-varying electromagnetic field, wherein a strength of the time-varying electromagnetic field within the coverage area is above a pre-determined threshold for fracturing the rock formation.

2. The system of claim 1, wherein the down-hole tool unit further comprises a control unit electrically coupled to the electromagnet, wherein the control unit is configured to control operation of the electromagnet based on control signals from the surface control unit.

3. The system of claim 2, wherein the system further comprises one or more cables coupled between the surface control unit and the down-hole tool unit, wherein the one or more cables are configured to transmit at least the control signals.

4. The system of claim 1, wherein the electromagnet comprises a coil, and wherein the down-hole tool unit further comprises a capacitor coupled to the coil.

5. The system of claim 4, wherein a capacitance of the capacitor and an inductance of the coil are tuned to be equal.

6. The system of claim 1, wherein the down-hole tool unit further comprises a non-magnetic housing around the electromagnet.

7. The system of claim 1, wherein the down-hole tool unit is configured to generate the time-varying electromagnetic field having a switching frequency, wherein the switching frequency of the time-varying electromagnetic field matches a resonance frequency of the rock formation.

8. The system of claim 1, wherein the down-hole tool unit is configured to generate the time-varying electromagnetic field having a switching frequency that gradually and continuously changes over a pre-determined range of frequencies, wherein a resonance frequency of the rock formation is within the pre-determined range of frequencies.

9. The system of claim 1, further comprising another down-hole tool unit, wherein the another down-hole tool unit comprises a pressure wave generating tool, wherein the pressure wave generating tool is configured to alternately generating a compressive pressure wave and an expansive pressure wave for fracturing the rock formation.

10. The system of claim 9, wherein the pressure wave generating tool comprises a piezoelectric transducer.

11. The system of claim 10, wherein an impedance of the piezoelectric transducer matches an impedance of a channel of the compressive pressure wave and the expansive pressure wave.

12. A down-hole unit for increasing a permeability of a strata, the down-hole unit comprising:

a tool comprising an electromagnet, wherein the tool is configured to apply a time-varying magnetic force on the strata through a time-varying electromagnetic field generated by the electromagnet, wherein a strength of the time-varying electromagnetic field is above a threshold for fracturing the strata;

a housing around the tool; and a cable electrically coupled to the tool.

13. The down-hole unit of claim 12, wherein the tool further comprises:

a capacitor coupled to the electromagnet; and a control unit coupled to the electromagnet and the capacitor.

14. The down-hole unit of claim 12, further comprising another tool that includes a piezoelectric transducer, wherein the another tool is configured to apply a time-varying force on the strata through compressive and expansive pressure waves generated by the piezoelectric transducer.

15. A method comprising:

positioning a down-hole tool unit at a first location of a well bore;

generating a time-varying magnetic field using the down-hole tool unit, wherein a strength of the time-varying magnetic field in a coverage area of the down-hole tool unit is above a first pre-determined threshold for fracturing a first rock formation proximate to the first location;

applying a first time-varying force to the first rock formation using the time-varying magnetic field; and fracturing the first rock formation using the first time-varying force.

16. The method of claim 15, wherein the down-hole tool unit comprises an electromagnet, wherein generating the time-varying magnetic field comprises:

generating, by the electromagnet, a first electromagnetic field with a first magnitude in a first direction for a first duration; and generating, by the electromagnet, a second electromagnetic field with a second magnitude in a second direction for a second duration.

17. The method of claim 15, further comprising:

adjusting a switching frequency of the time-varying magnetic field to match a resonance frequency of the first rock formation proximate to the first location.

18. The method of claim 15, further comprising:

generating a time-varying pressure wave using the down-hole tool unit, wherein a strength of the time-varying pressure wave in the coverage area of the down-hole tool unit is above a second pre-determined threshold for fracturing the first rock formation; and applying a second time-varying force to the first rock formation using the time-varying pressure wave.

19. The method of claim 18, wherein the down-hole tool unit comprises a piezoelectric transducer, wherein generating the time-varying pressure wave comprises:

generating, by the piezoelectric transducer, a compressive pressure wave with a first magnitude for a first duration; and generating, by the piezoelectric transducer, an expansive pressure wave with a second magnitude for a second duration.

20. The method of claim 18, further comprising adjusting a switching frequency of the time-varying pressure wave to match a resonance frequency of the first rock formation.

* * * * *